US010756517B1

(12) United States Patent
Kawamura et al.

(10) Patent No.: US 10,756,517 B1
(45) Date of Patent: Aug. 25, 2020

(54) SPARK PLUG

(71) Applicant: NGK SPARK PLUG CO., LTD., Nagoya-shi, Aichi (JP)

(72) Inventors: Yusuke Kawamura, Nagoya (JP); Shunsuke Tsuga, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/837,154

(22) Filed: Apr. 1, 2020

(30) Foreign Application Priority Data

Apr. 24, 2019 (JP) ..... 2019-082783

(51) Int. Cl.
*H01T 13/06* (2006.01)
*H01T 13/20* (2006.01)

(52) U.S. Cl.
CPC ..... *H01T 13/06* (2013.01); *H01T 13/20* (2013.01)

(58) Field of Classification Search
CPC ..... H01T 13/06; H01T 13/20
See application file for complete search history.

(56) References Cited

U.S. PATENT DOCUMENTS 5,105,780 A 4/1992 Richardson
8,584,648 B2 * 11/2013 Chiera ..... H01T 13/54 123/266
9,653,886 B2 * 5/2017 Chiera ..... H01T 13/06
9,856,848 B2 * 1/2018 Chiera ..... F02B 19/1095
10,116,122 B2 * 10/2018 Rabhi ..... H01T 13/40
10,174,667 B1 * 1/2019 Cress ..... F02B 19/08
2015/0114332 A1 * 4/2015 Stifel ..... H01T 13/54 123/143 B
2016/0079739 A1 * 3/2016 Okazaki ..... H01T 13/08 313/143
2020/0106246 A1 * 4/2020 Gozawa ..... H01T 13/18

FOREIGN PATENT DOCUMENTS

JP 2545621 Y2 8/1997

* cited by examiner

*Primary Examiner* — Kevin Quarteman
(74) *Attorney, Agent, or Firm* — Kusner & Jaffe

(57) ABSTRACT

A spark plug that provides an increase in the combustion speed of an engine. The spark plug includes a center electrode, a ground electrode, an insulator, and a cover portion. In a cross-sectional area of a region surrounded by an inner wall surface of the cover portion in a cross section taken along a plane perpendicular to an axial line CX of the spark plug, the cover portion includes: a narrow portion positioned on the front end side with respect to the ground electrode in the direction of the axial line CX and narrowed such that the cross-sectional area is smallest; and a cover front portion positioned on the front end side of the narrow portion and having the cross-sectional area that is larger than the cross-sectional area of the narrow portion and that is largest at the front end of the cover front portion.

8 Claims, 9 Drawing Sheets

SPARK PLUG

FIELD OF THE INVENTION

The present invention relates to a spark plug.

BACKGROUND OF THE INVENTION

Japanese Registered Utility Model No. 2545621 ("PTL 1") discloses a spark plug including a capsule that forms an ignition chamber. The spark plug is configured such that the ignition chamber has a narrowest portion in an electrode gap or in the vicinity thereof and such that the diameter of the ignition chamber decreases from a first plane positioned below the narrowest portion toward the bottom. The capsule forming the ignition chamber includes four side orifices and one bottom orifice.

In the spark plug, when a spark is generated in the electrode gap, the spark ignites an inflammable air-fuel mixture in the ignition chamber. The ignited air-fuel mixture expands and injects flame through the side orifices and the bottom orifice. These flame jets ignite an inflammable air-fuel mixture in a main combustion chamber.

According to the technology disclosed in PTL 1, however, even when an effect of increasing the temperature of a combustion gas in a pre-chamber by narrowing a portion of the ignition chamber is exerted, the diameter of the ignition chamber is decreased below the narrowest portion and therefore, there is a possibility of a pressure loss occurring at the decreased-diameter portion. In addition, according to the technology disclosed in PTL 1, since the capsule includes the bottom orifice, the length of flame injected from the side orifices may decrease. As a result, there is a possibility that high-temperature flame may not reach the end of the combustion chamber and the combustion speed of an engine may decrease, which is a problem.

SUMMARY OF THE INVENTION

The present invention was developed in consideration of the aforementioned circumstances, and an object of the present invention is to increase the combustion speed of an engine. The present invention can be embodied as the following forms.

A spark plug as one aspect of the present invention includes:

a center electrode;

a ground electrode that includes a facing portion facing a front end portion of the center electrode and forms a discharge gap between the facing portion and the front end portion of the center electrode;

a cylindrical insulator that accommodates the center electrode therein with the front end portion of the center electrode being exposed from a front end of the insulator;

a metal shell that accommodates the insulator therein; and a cover portion that covers, from a front end side of the spark plug, the front end portion of the center electrode and the facing portion of the ground electrode to form a pre-chamber, the cover portion including an injection hole that is a through hole.

Regarding a cross-sectional area of a region surrounded by an inner wall surface of the cover portion in the cross section taken along a plane perpendicular to an axial line of the spark plug, the cover portion includes a narrow portion positioned on the front end side with respect to the ground electrode in a direction of the axial line and narrowed such that the cross-sectional area is smallest, and a cover front portion positioned on a front end side of the narrow portion and having the cross-sectional area that is larger than the cross-sectional area of the narrow portion and that is largest at a front end of the cover front portion, The cover front portion has a first region that is obtained by projecting a region of the narrow portion surrounded by the inner wall surface onto a front-end-side surface of the inner wall surface in the direction of the axial line, and a second region positioned in the inner wall surface to surround the first region.

Only the second region includes the injection hole.

According to this configuration, since the cover portion includes the narrow portion, it is possible to increase the temperature of a combustion gas in the pre-chamber. Moreover, since the injection hole is not formed in the first region but formed in the second region of the cover front portion, it is possible to cause flame that has a speed increased by passing through the narrow portion to be injected from the injection hole formed in the second region toward the outside in the radial direction of the spark plug. As a result, high-temperature flame easily reaches the side end of a combustion chamber, and it is thus possible to increase the combustion speed of an engine.

In the aforementioned spark plug, the cover portion may further include, on the front end side with respect to the ground electrode, a cover rear portion positioned on a rear end side of the narrow portion.

When the cross-sectional area of the cover rear portion that is largest is denoted by a first cross-sectional area S1 and the cross-sectional area of the narrow portion is denoted by a second cross-sectional area S2, the second cross-sectional area S2 may be 0.05 times or more and 0.15 times or less the first cross-sectional area S1.

According to this configuration, since the second cross-sectional area S2 is 0.15 times or less the first cross-sectional area S1, it is possible to effectively increase the temperature of a combustion gas in the pre-chamber. Moreover, since the second cross-sectional area S2 is 0.05 times or more the first cross-sectional area S1, it is possible to suppress a pressure loss which may be caused due to the provision of the narrow portion. As a result, an effect of increasing the temperature of a combustion gas in the pre-chamber and an effect of suppressing a pressure loss can be both exerted, and it is thus possible to effectively increase the combustion speed of an engine.

In the aforementioned spark plug, the cover portion may further include, on the front end side with respect to the ground electrode, a cover rear portion positioned on a rear end side of the narrow portion.

The cover rear portion may include a first tapered portion having a shape in which a diameter thereof decreases continuously toward the narrow portion.

According to this configuration, it is possible to suppress a pressure loss which may be caused due to the provision of the narrow portion.

In the aforementioned spark plug, the cover rear portion may include, between the first tapered portion and the narrow portion, a second tapered portion having a shape in which a diameter thereof decreases continuously toward the narrow portion.

An angle made by the inner wall surface of the second tapered portion and the axial line may be smaller than an angle made by the inner wall surface of the first tapered portion and the axial line.

According to this configuration, since the tapered shape of the cover rear portion is a shape in which the diameter thereof decreases gradually, it is possible to further reduce a pressure loss which may be caused due to the provision of the narrow portion.

In the aforementioned spark plug, the cover front portion may include, at a position on the rear end side with respect to the injection hole, a third tapered portion having a shape in which a diameter thereof increases continuously from the narrow portion toward the front end side.

According to this configuration, flame that has passed through the narrow portion easily spreads along the third tapered portion to the injection hole, and it is thus possible to cause the flame to be injected from the injection hole toward the outside in the radial direction of the spark plug.

In the aforementioned spark plug, in the inner wall surface of the cover portion, at least one of portions in each of which an inner diameter thereof changes may be a portion where the inner diameter changes gradually.

According to this configuration, it is possible to suppress a pressure loss at the portion where the inner diameter changes in the inner wall surface of the cover portion.

In the aforementioned spark plug, the front-end surface of the inner wall surface of the cover front portion may has a convex shape that rises toward the narrow portion.

According to this configuration, the flame that has passed through the narrow portion can be caused to move along the front-end-side surface of the inner wall surface of the cover front portion toward the injection hole, and it is thus possible to cause the flame to be injected from the injection hole toward the outside in the radial direction of the spark plug.

In the aforementioned spark plug, the cover portion may include:

a first member that forms at least the narrow portion, and a second member that forms at least a portion of the cover front portion.

According to this configuration, the narrow portion and the cover front portion can be easily formed in the first member and the second member, respectively, which facilitates manufacture of the cover portion.

DETAILED DESCRIPTION OF INVENTION

First Embodiment

Hereinafter, a first embodiment of a spark plug 100 will be described in detail with reference to the drawings. In the following description, the lower side of FIG. 1 is the front end side (front side) of the spark plug 100, and the upper side of FIG. 1 is the rear end side thereof.

Figure 1:
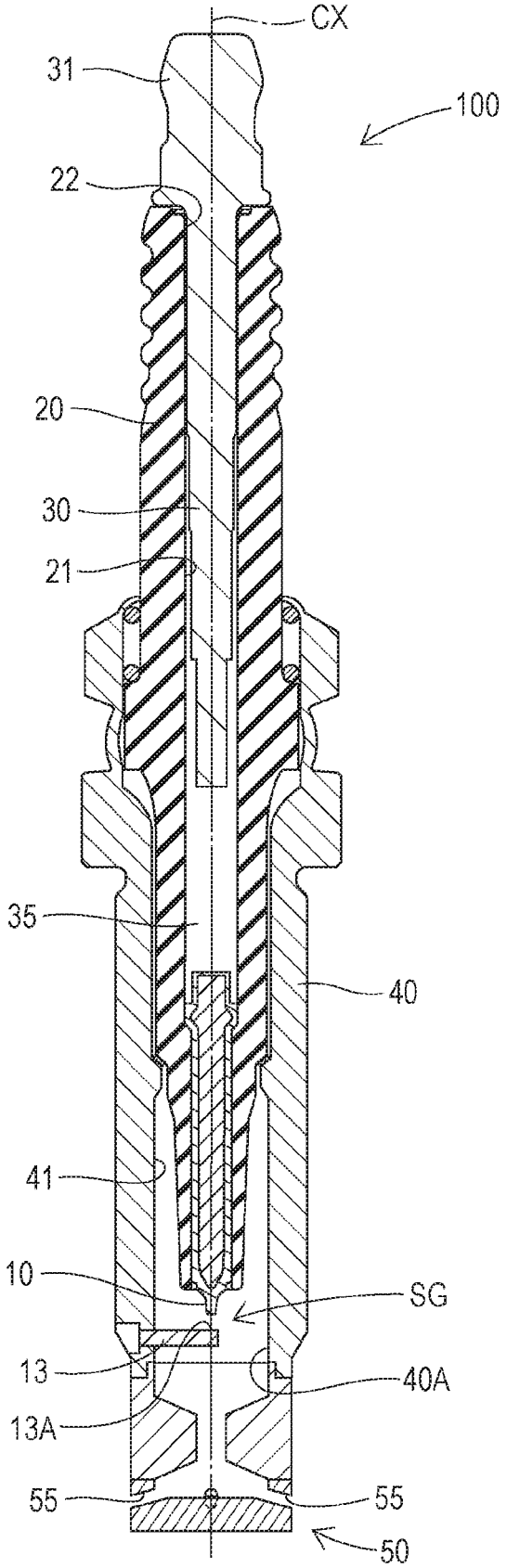
FIG. 1 is a sectional view illustrating a configuration of a spark plug according to a first embodiment.

FIG. 1 is a sectional view illustrating an outline configuration of the spark plug 100 in the first embodiment.

Figure 4:
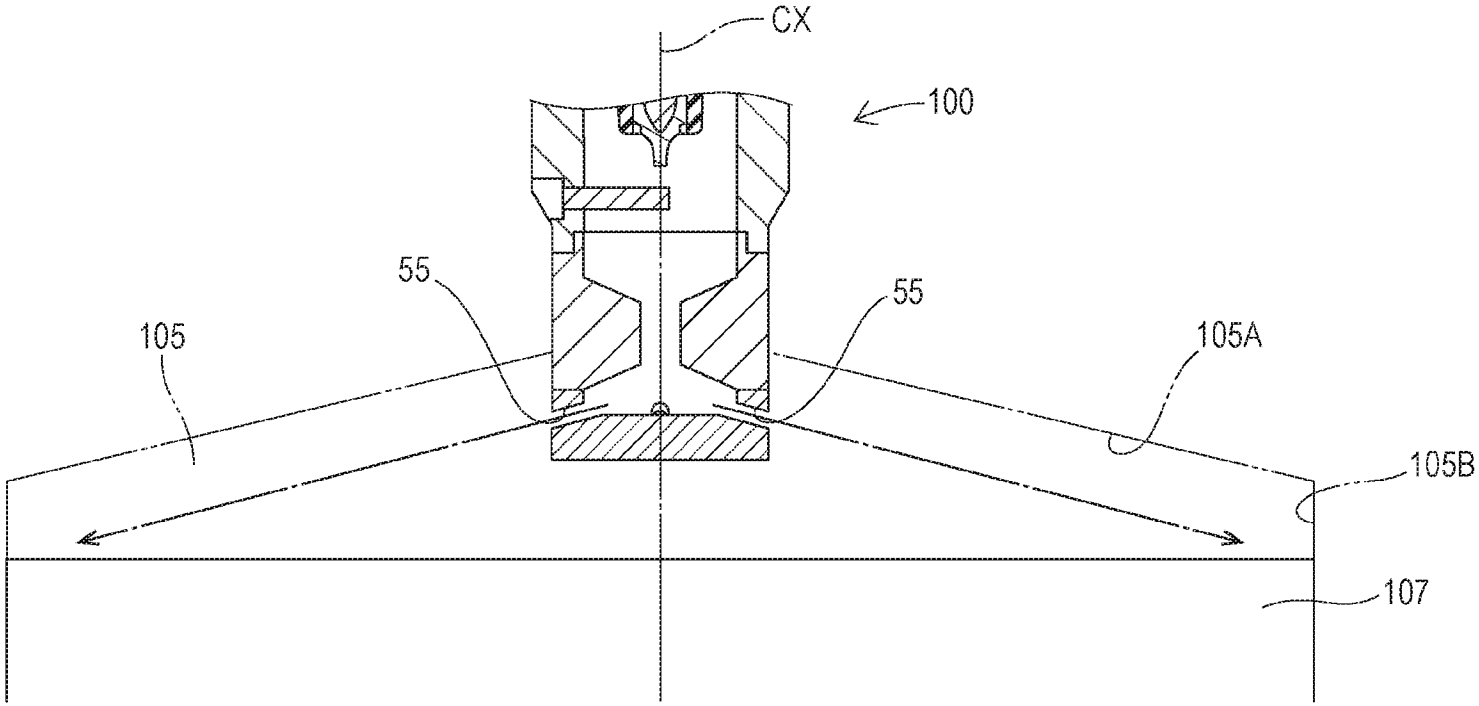
FIG. 4 is a sectional view illustrating a state in which the spark plug is disposed in an internal combustion engine.

In FIG. 1, a center axial line CX of the spark plug 100 (an axial line of the spark plug) is indicated by a one-dot chain line. In FIG. 4, a ceiling surface 105A and a side wall surface 105B of a combustion chamber 105 when the spark plug 100 is mounted on an internal combustion engine are indicated by two-dot chain lines. In FIG. 4, a piston 107 positioned at a top dead point in the combustion chamber 105 is illustrated.

The spark plug 100 is mounted on an internal combustion engine and used to ignite the internal combustion engine. When mounted on the internal combustion engine, the front end side of the spark plug 100 (lower side in FIG. 1) is disposed inside the combustion chamber 105 of the internal combustion engine, and the rear end side (upper side in FIG. 1) is disposed outside the combustion chamber 105. As illustrated in FIG. 1, the spark plug 100 includes a center electrode 10, a ground electrode 13, an insulator 20, a terminal electrode 30, and a metal shell 40.

The center electrode 10 is constituted by a shaft-shaped electrode member and disposed in such a manner that a center axis thereof is coincident with the center axial line CX of the spark plug 100. The center electrode 10 is held by the metal shell 40 with the insulator 20 interposed therebetween in such a manner that a front end portion 11 is positioned in a front-end-side opening portion 40A of the metal shell 40. The center electrode 10 is electrically connected to an external power source via the terminal electrode 30 disposed on the rear end side.

The ground electrode 13 is a rod-shaped electrode extending toward the front end portion 11 of the center electrode 10. In the front-end-side opening portion 40A of the metal shell 40, the ground electrode 13 extends from an inner peripheral surface toward the inner side. The ground electrode 13 extends up to the front of the front end portion 11 of the center electrode 10. The ground electrode 13 includes a facing portion 13A facing the front end portion 11 of the center electrode 10. A discharge gap SG is formed between the facing portion 13A of the ground electrode 13 and the front end portion 11 of the center electrode 10.

The insulator 20 is a cylindrical member including an axial hole 21 penetrating through the center thereof. The insulator 20 is constituted by, for example, a ceramic sintered body made of alumina or aluminum nitride. On the front end side of the axial hole 21 of the insulator 20, the center electrode 10 is accommodated with the front end portion 11 thereof being exposed. On the rear end side of the axial hole 21, the terminal electrode 30, which is a shaft-shaped electrode member, is held. A rear end portion 31 of the terminal electrode 30 extends out from a rear-end opening portion 22 of the insulator 20 so as to be connectable with the external power source. The center electrode 10 and the terminal electrode 30 are electrically connected to each other via a resistor 35 that is held between glass sealing materials in order to suppress generation of radio interference noise when a spark discharge occurs. The center axis of the insulator 20 is coincident with the center axial line CX of the spark plug 100.

The metal shell 40 is a substantially cylindrical metal member including a cylinder hole 41 at the center thereof and accommodates the insulator 20 therein. The metal shell 40 is constituted of, for example, carbon steel. The center axis of the metal shell 40 is coincident with the center axial line CX of the spark plug 100. As described above, the ground electrode 13 is mounted in the front-end-side opening portion 40A of the metal shell 40.

Figure 2:
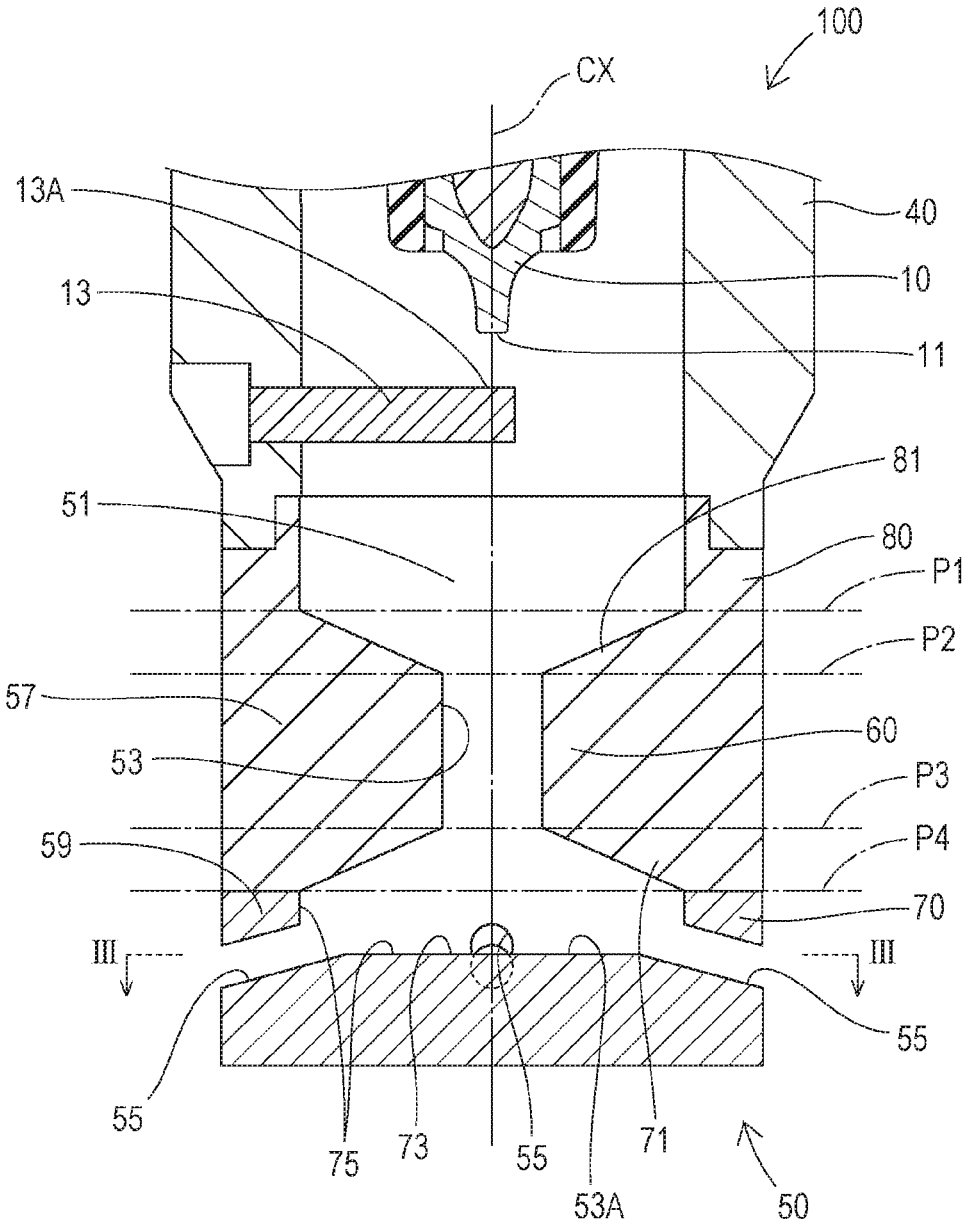
FIG. 2 is a partial enlarged sectional view of the spark plug.

As illustrated in FIG. 2, the spark plug 100 includes a cover portion 50. The cover portion 50 has a bottomed cylindrical shape having a bottom wall portion and a side wall portion. The rear end of the cover portion 50 is fixed to the front end of the metal shell 40. The cover portion 50 covers, from the front end side, the front end portion 11 of the center electrode 10 and the facing portion 13A of the ground electrode 13 to form a pre-chamber 51. In other words, the pre-chamber 51 is a space surrounded by an inner wall surface 53 of the cover portion 50 and the inner peripheral surface of the metal shell 40. The cover portion 50 includes injection holes 55 as through holes.

The cover portion 50 includes a narrow portion 60, a cover front portion 70 positioned on the front end side of the narrow portion 60, and a cover rear portion 80 positioned on the rear end side of the narrow portion 60. In the cover portion 50, the cover rear portion 80, the narrow portion 60, and the cover front portion 70 are disposed on the front end side with respect to the ground electrode 13 in this order toward the front end side. The cover portion 50 has a configuration in which an inner diameter thereof changes toward the front end side. This configuration will be described using relations with respect to a first plane P1 to a fourth plane P4, which are virtual planes perpendicular to the center axial line CX. On the front end side of the ground electrode 13, the cover portion 50 has an inner diameter that is constant up to the first plane P1, and the inner diameter decreases from the first plane P1 up to the second plane P2. The portion up to the second plane P2 is the cover rear portion 80. The inner diameter of the cover portion 50 is constant from the second plane P2 up to the third plane P3. The portion from the second plane P2 up to the third plane P3 is the narrow portion 60. The inner diameter of the cover portion 50 increases from the third plane P3 up to the fourth plane P4, and the inner diameter is constant from the fourth plane P4 up to a front-end-side surface (hereinafter also referred to as front-end surface) 53A of the inner wall surface 53. The portion from the third plane P3 up to the front-end surface 53A is the cover front portion 70. The cover portion 50 has an outer diameter that is constant from the ground electrode 13 up to the front-end surface 53A, and has a circular columnar outer shape. In the following description, when simply referred to as a cross-sectional area in the description of the narrow portion 60, the cover front portion 70, and the cover rear portion 80, it refers to a cross sectional area of a region surrounded by the inner wall surface 53 of the cover portion 50 in a cross section taken along a plane perpendicular to the center axial line CX. The cross-sectional area can be confirmed by observing a cross section of the spark plug 100 and, alternatively, can be confirmed by observing a sectional image obtained by an X-ray CT (computed tomography) scanner or the like.

The cover portion 50 includes a first member 57 and a second member 59. The first member 57 is a member that forms at least the narrow portion 60. Specifically, the first member 57 is a member that constitutes, in the cover portion 50, a portion on the rear side with respect to the fourth plane P4. As a result of a circular columnar component being machined from both front and rear sides, the first member 57 is provided with the shape of the cover rear portion 80, the narrow portion 60, and a front tapered portion 71 of the cover front portion 70. The second member 59 is a member that constitutes, in the cover portion 50, a portion on the front side with respect to the fourth plane P4. As a result of a circular columnar component being machined from the rear side, the second member 59 is provided with the shape of a portion of the cover front portion 70 other than the front tapered portion 71. The first member 57 and the second member 59 are integrated to each other by, for example, welding or the like and constitute the cover portion 50.

The cover rear portion 80 has a cross-sectional area larger than that of the narrow portion 60. The cover rear portion 80 is constituted of a portion having a cross-sectional area that is constant in the direction of the center axial line CX and a portion having a cross-sectional area that decreases toward the front end side. The cover rear portion 80 includes a rear tapered portion (first tapered portion) 81 having a shape in which the diameter thereof decreases continuously toward the narrow portion 60. Specifically, in the cover rear portion 80, a region surrounded by the inner wall surface 53 has a circular cross-section. The cover rear portion 80 includes, up to the first plane P1, a circular column-shaped inner space having the center axial line CX as the axis thereof and includes, from the first plane P1 up to the second plane P2, a truncated cone-shaped inner space having the center axial line CX as the axis thereof.

The narrow portion 60 is positioned on the front end side with respect to the ground electrode 13 in the direction of the center axial line CX and narrowed to have a smallest cross-sectional area. Specifically, in the narrow portion 60, a region surrounded by the inner wall surface 53 has a circular cross-section. The narrow portion 60 includes a circular column-shaped inner space having the center axial line CX as the axis thereof. The inner space of the narrow portion 60 and the inner spaces of the cover rear portion 80 are coaxial with each other and in communication with each other. The narrow portion 60 is larger than the cover rear portion 80 and the cover front portion 70 in terms of thickness in a direction orthogonal to the center axial line CX. In other words, the narrow portion 60 is a thick portion in the cover portion 50 which has a large thermal capacity and is not easily cooled. The cross-sectional area of the narrow portion 60 will be described later.

The cover front portion 70 has a cross-sectional area that is larger than that of the narrow portion 60 and that is largest at the front end of the cover front portion 70. The largest cross-sectional area of the cover front portion 70 is equivalent to the largest cross-sectional area of the cover rear portion 80. The cover front portion 70 is constituted of a portion having a cross-sectional area that increases toward the front end side and a portion having a cross-sectional area that is constant in the direction of the center axial line CX. The cover front portion 70 includes, at a position on the rear end side with respect to the injection holes 55, the front tapered portion (third tapered portion) 71 having a shape in which the diameter thereof increases continuously from the narrow portion 60 toward the front end side. Specifically, in the cover front portion 70, a region surrounded by the inner wall surface 53 has a circular cross-section. The cover front portion 70 includes, from the third plane P3 up to the fourth plane P4, a truncated cone-shaped space having the center axial line CX as the axis thereof and includes, from the fourth plane P4 up to the front-end surface 53A, a circular column-shaped space having the center axial line CX as the axis thereof. The cover front portion 70 is closed at the front end thereof by a disc-shaped bottom wall portion. The inner surface of the bottom wall portion constitutes the front-end surface 53A.

Figure 3:
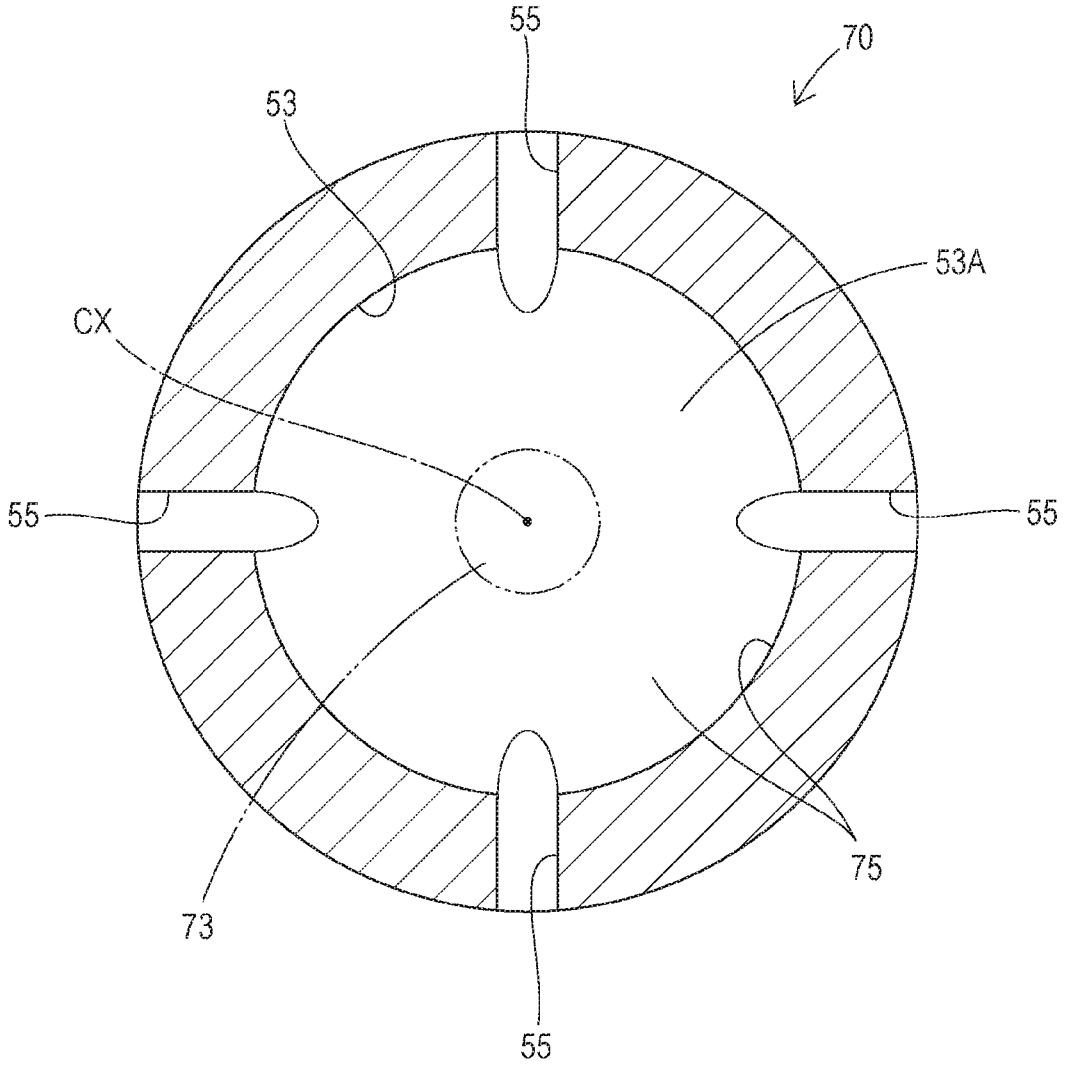
FIG. 3 is a sectional view taken along line III-III of FIG. 2, illustrating a first region and a second region of a cover front portion.

As illustrated in FIG. 2 and FIG. 3, the cover front portion 70 has a first region 73 that is obtained by projecting a region of the narrow portion 60 surrounded by the inner wall surface 53 onto the front-end surface 53A in the direction of the center axial line CX, and a second region 75 that is positioned in the inner wall surface 53 to surround the first region 73. The first region 73 is a circular region positioned at the center of the front-end surface 53A. The first region 73 is a region positioned, in the inner wall surface 53, at the front of the flame that has passed through the narrow portion 60. The second region 75 is an entire region of the cover front portion 70 excluding the first region 73 and includes both of the inner surface of the bottom wall portion and the inner surface of the side wall portion.

In the cover portion 50, only the second region 75 includes the injection holes 55. In the present embodiment, the injection holes 55 are formed, in the second region 75, in the vicinity of corner portions between the bottom wall portion and the side wall portion. A plurality (for example, four to eight) of the injection holes 55 is formed. The plurality of injection holes 55 is positioned on a virtual circumference centered on the center axial line CX of the spark plug 100. The injection holes 55 are arranged at equal intervals on the virtual circumference. Each of the injection holes 55 is a through hole having a circular cross-section. The injection holes 55 are in communication with the pre-chamber 51 (ignition chamber), which is a space covered by the cover portion 50, and the combustion chamber 105. In a state where the spark plug 100 is set in the combustion chamber 105, the injection holes 55 are formed so as to penetrate the spark plug 100 toward the side of the combustion chamber 105. Specifically, the injection holes 55 penetrate toward the outside in the radial direction of the spark plug 100 and are sloped such that the penetrating direction declines toward the outside in the radial direction of the spark plug 100.

Figure 5:
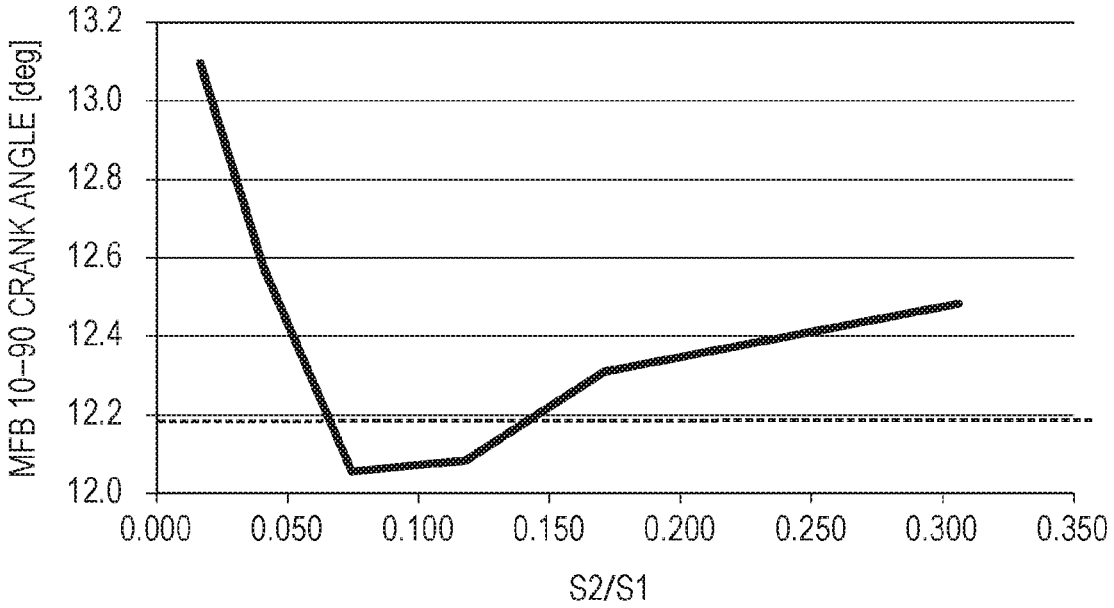
FIG. 5 is a graph showing a relation between a ratio (S2/S1) of S2 to S1 and the combustion speed of the engine.

Next, the cross-sectional area of the narrow portion 60 will be described. With the largest cross-sectional area of the cover rear portion 80 denoted by a first cross-sectional area S1 and the cross-sectional area of the narrow portion 60 denoted by a second cross-sectional area S2, simulation on a relation between a ratio (S2/S1) of S2 to S1 and the combustion speed of an engine was performed. The combustion speed of the engine was evaluated in MFB (Mass Fraction Burnt), which is a rate at which fuel is combusted, and, as an evaluation index, a crank angle at which MFB is 10% to 90% (MFB 10-90 crank angle [deg]), was used. When the value of the MFB 10-90 crank angle [deg] is small, combustion speed is high. Results of the simulation are shown in table 1 and the graph in FIG. 5. When similar simulation was performed regarding a cover portion that does not include the narrow portion 60 and that has a cross-sectional area equal to the first cross-sectional area S1 throughout the entire region of the cover portion, the MFB 10-90 crank angle [deg] was 12.2 (indicated by a broken line in the graph of FIG. 5).

TABLE 1

| S2/S1 | 0.019 | 0.043 | 0.077 | 0.121 | 0.174 | 0.309 |
|---|---|---|---|---|---|---|
| MFB 10-90 crank angle [deg] | 13.1 | 12.6 | 12.1 | 12.1 | 12.3 | 12.5 |

The simulation results show that the cross-sectional area of the narrow portion 60 is preferably in the following ranges. The second cross-sectional area S2 is preferably 0.05 times or more and 0.15 times or less the first cross-sectional area S1. The second cross-sectional area S2 is more preferably 0.07 times or more the first cross-sectional area S1. The second cross-sectional area S2 is more preferably 0.13 times or less the first cross-sectional area S1. When the second cross-sectional area S2 has a value more than or equal to the lower limit value of the aforementioned ranges, it is possible to ensure a gas passage in the pre-chamber 51 and reduce the pressure loss. When the second cross-sectional area S2 has a value less than or equal to the upper limit value of the aforementioned ranges, it is possible to increase the temperature of a combustion gas in the pre-chamber 51 by the narrow portion 60. The simulation results show that, compared with a spark plug without the narrow portion 60, the spark plug 100 can obtain an effect of improving the combustion speed by 1.3% at maximum.

Next, effects of the present embodiment will be described. According to the present embodiment, since the cover portion 50 includes the narrow portion 60, it is possible to increase the temperature of a combustion gas in the pre-chamber 51. Specifically, since the narrow portion 60 is provided so as to project in the pre-chamber 51, the temperature of the combustion gas in the vicinity of the discharge gap SG in the pre-chamber 51 is suppressed from becoming a predetermined temperature or lower due to the heat stored in the narrow portion 60. In addition, since the injection holes 55 are not formed in the first region 73 of the cover front portion 70 but formed in the second region 75, it is possible to cause flame that has a speed increased by passing through the narrow portion 60 to be injected from the injection holes 55 formed in the second region 75 toward the outside in the radial direction of the spark plug 100. If the injection holes are formed in only the first region 73, the flame that has passed through the narrow portion 60 is injected from the injection holes toward the front end side. In this case, the flame is injected toward the piston 107 and the like and may not reach the vicinity of the side wall surface 105B of the combustion chamber 105. In contrast, in the present embodiment, the injection holes 55 are formed only in the second region 75, and thus, the flame that has passed through the narrow portion 60 is injected from the injection holes 55 toward the side wall surface 105B of the combustion chamber 105. At this time, since the injection holes 55 are not formed in the first region 73, it is possible to increase the length of the flame injected from the injection holes 55, compared with a configuration in which the injection holes 55 are formed in both of the first region 73 and the second region 75. As a result, high-temperature flame easily reaches the side-end portion of the combustion chamber 105, as indicated by the one-dot chain line in FIG. 4, and it is thus possible to increase the combustion speed of the engine.

In the present embodiment, when the largest cross-sectional area of the cover rear portion 80 is denoted by the first cross-sectional area S1 and the cross-sectional area of the narrow portion 60 is denoted by the second cross-sectional area S2, the second cross-sectional area S2 is 0.05 times or more and 0.15 times or less the first cross-sectional area S1. Since the second cross-sectional area S2 is 0.15 times or less the first cross-sectional area S1, it is possible to effectively increase the temperature of the combustion gas in the pre-chamber 51. Moreover, since the second cross-sectional area S2 is 0.05 times or more the first cross-sectional area S1, it is possible to suppress a pressure loss which may be caused due to the provision of the narrow portion 60. As a result, the effect of improving the temperature of a combustion gas in the pre-chamber 51 and the effect of suppressing a pressure loss can be both exerted, and it is thus possible to effectively increase the combustion speed of the engine.

In the present embodiment, the cover rear portion 80 includes the rear tapered portion 81 having the shape in which the diameter thereof decreases continuously toward the narrow portion 60. According to this configuration, it is possible to suppress a pressure loss which may be caused due to the provision of the narrow portion 60.

In the present embodiment, the cover front portion 70 includes, at a position on the rear end side with respect to the injection holes 55, the front tapered portion 71 having the shape in which the diameter thereof increases continuously from the narrow portion 60 toward the front end side. According to this configuration, flame that has passed through the narrow portion 60 easily spreads along the front tapered portion 71 to the injection holes 55, and it is thus possible to cause the flame to be injected from the injection holes 55 toward the outside in the radial direction of the spark plug 100.

In the present embodiment, the cover portion 50 includes the first member 57 that forms at least the narrow portion 60 and the second member 59 that forms at least a portion of the cover front portion 70. According to this configuration, the narrow portion 60 and the cover front portion 70 can be easily formed in the first member 57 and the second member 59, respectively, which facilitates manufacture of the cover portion 50.

Second Embodiment

Figure 6:
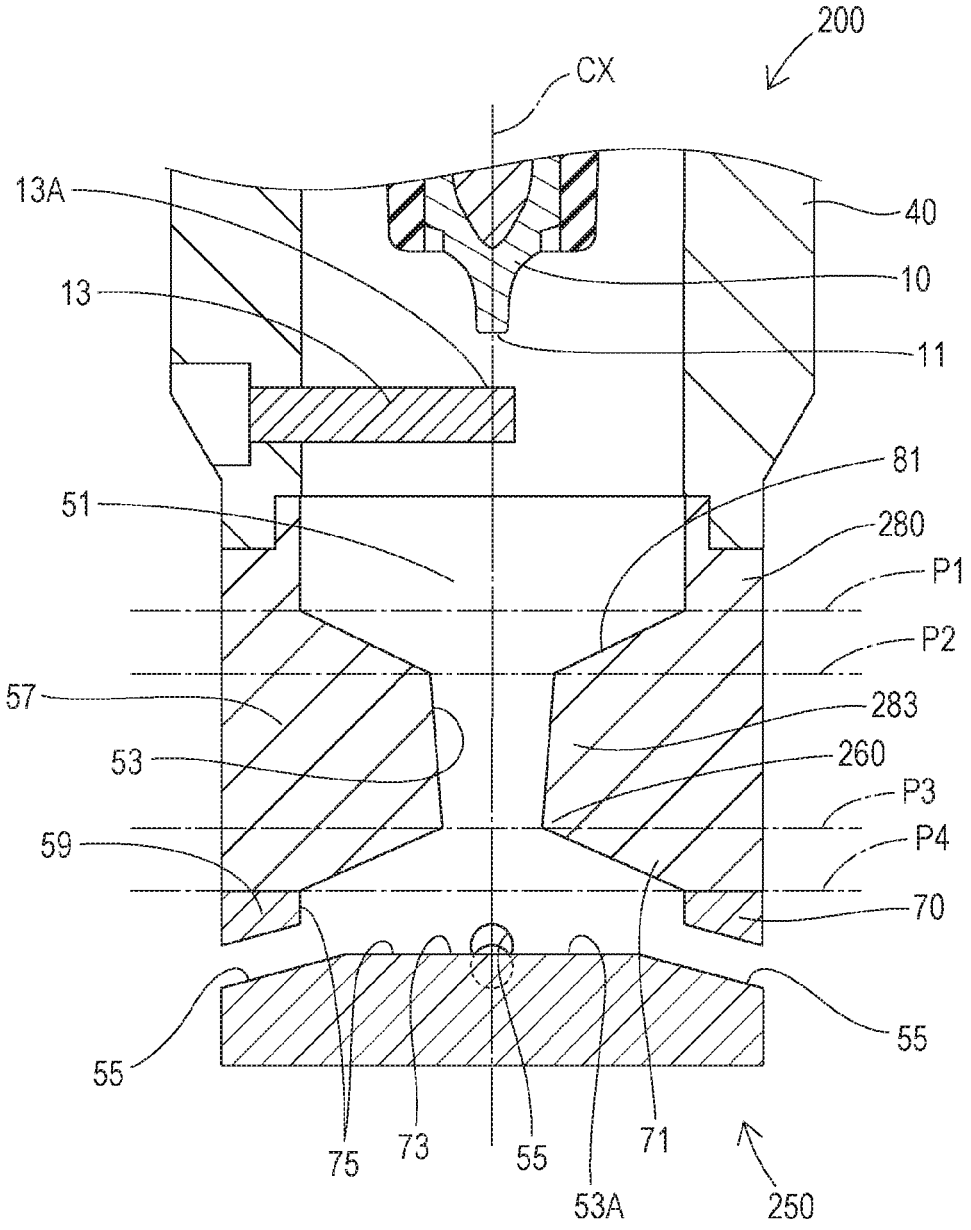
FIG. 6 is a partial enlarged sectional view of a spark plug according to a second embodiment.

Next, a spark plug 200 according to a second embodiment will be described with reference to FIG. 6. The spark plug 200 of the second embodiment differs from the spark plug 100 according to the first embodiment in terms of the configuration of a cover rear portion 280 and a narrow portion 260 of a cover portion 250. The other configurations are substantially the same as those in the spark plug 100 according to the first embodiment. Components having substantially the same configurations are thus given identical reference characters, and description of structures, actions, and effects thereof is omitted.

On the front end side of the ground electrode 13, the cover portion 250 has an inner diameter that is constant up to the first plane P1, and the inner diameter decreases from the first plane P1 up to the second plane P2. The inner diameter then decreases more gently from the second plane P2 up to the third plane P3. The portion from the ground electrode 13 up to the third plane P3 is the cover rear portion 280. The cover portion 250 has the smallest inner diameter at the third plane P3. The portion positioned at the third plane P3 is the narrow portion 260. In the cover portion 250, the configuration of a portion on the front end side with respect to the third plane P3 is the same as that in the first embodiment, and description thereof is thus omitted. In other words, in the cover portion 250 of the present embodiment, an inner space of the narrow portion 260 is not formed so as to extend in the direction of the center axial line CX. Only the front end of the narrow portion 60 of the first embodiment corresponds to the narrow portion 260 of the present embodiment, and a portion on the rear side with respect to the front end of the narrow portion 60 of the first embodiment constitutes a second tapered portion 283 of the cover rear portion 280 of the present embodiment.

The cover rear portion 280 includes, between the rear tapered portion (first tapered portion) 81 and the narrow portion 260, the second tapered portion 283 having a shape in which the diameter thereof decreases continuously toward the narrow portion 260. An angle made by the inner wall surface 53 of the second tapered portion 283 and the center axial line CX is smaller than an angle made by the inner wall surface 53 of the rear tapered portion 81 and the center axial line CX. The angles made by the inner wall surface 53 and the center axial line CX are compared at respective acute angles. In other words, a gradient angle of the second tapered portion 283 is smaller than a gradient angle of the rear tapered portion 81, and the second tapered portion 283 has a gentler gradient angle than the rear tapered portion 81. A configuration in which the gradient angle of the second tapered portion is 0° corresponds to the configuration of the narrow portion 60 of the first embodiment. The angle (acute angle) made by the inner wall surface 53 of the second tapered portion 283 and the center axial line CX is smaller than an angle (acute angle) made by the front tapered portion 71 and the center axial line CX.

In the present embodiment, since the tapered shape of the cover rear portion 280 is a shape in which the diameter thereof decreases gradually, it is possible to further reduce the pressure loss which may be caused due to the provision of the narrow portion 260.

Third Embodiment

Figure 7:
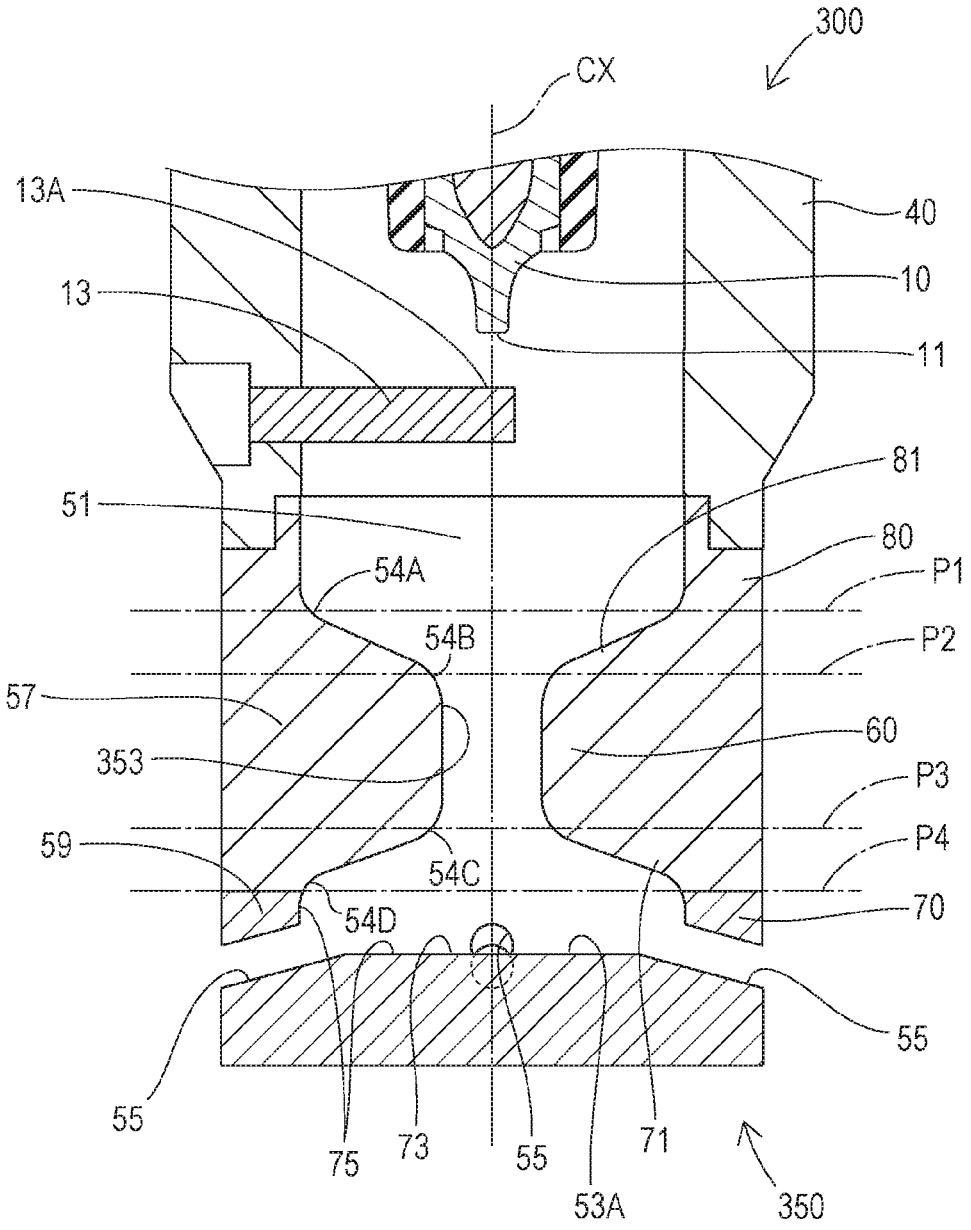
FIG. 7 is a partial enlarged sectional view of a spark plug according to a third embodiment.

Next, a spark plug 300 according to a third embodiment will be described with reference to FIG. 7. The spark plug 300 of the third embodiment differs from the spark plug 100 according to the first embodiment in terms of the shape of an inner wall surface 353 of a cover portion 350. The other configurations are substantially the same as those in the spark plug 100 according to the first embodiment. Components having substantially the same configurations are thus given identical reference characters, and description of structures, actions, and effects thereof is omitted.

In the inner wall surface 353 of the cover portion 350, at least one of portions 54A, 54B, 54C, and 54D in each of which the inner diameter thereof changes is a portion where the inner diameter changes gradually. Specifically, in the cover portion 350, the portions positioned on the first plane P1 to the fourth plane P4 are the portions 54A, 54B, 54C, and 54D, in each of which the inner diameter thereof changes. In the cover portion 350, these portions 54A, 54B, 54C, and 54D form an R-shape. In other words, the portions 54A and 54B have such a shape that is obtained by chamfering corner portions on both sides of the rear tapered portion 81 in the direction of the center axial line CX, and the portions 54C and 54D have such a shape that is obtained by chamfering corner portions on both sides of the front tapered portion 71 in the direction of the center axial line CX.

According to the present embodiment, it is possible to suppress a pressure loss at the portions in each which the inner diameter thereof changes in the inner wall surface 353 of the cover portion 350.

Fourth Embodiment

Figure 8:
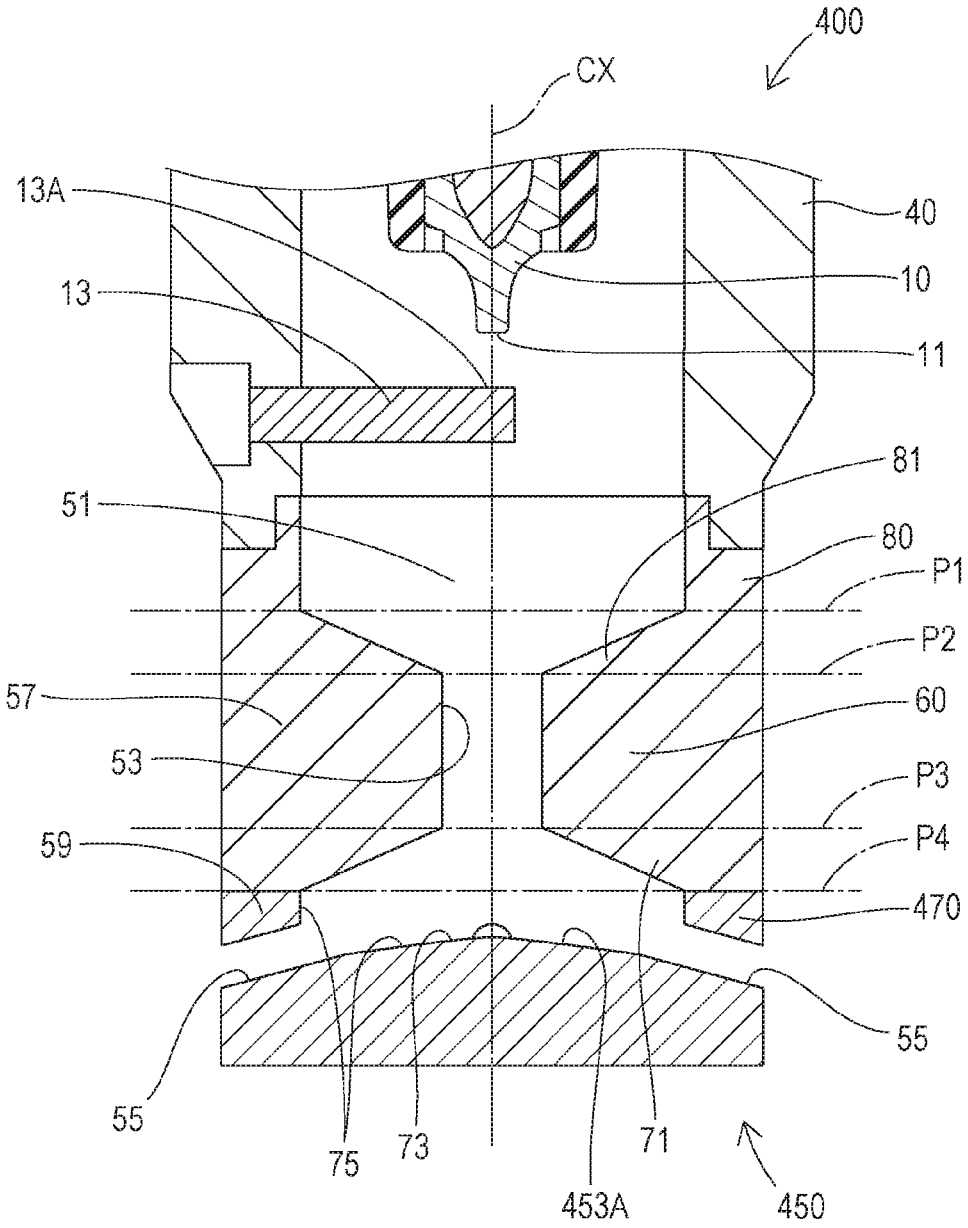
FIG. 8 is a partial enlarged sectional view of a spark plug according to a fourth embodiment.

Next, a spark plug 400 according to a fourth embodiment will be described with reference to FIG. 8. The spark plug 400 of the fourth embodiment differs from the spark plug 100 according to the first embodiment in terms of the shape of a front-end surface 453A of a cover front portion 470 of a cover portion 450. The other configurations are substantially the same as those in the spark plug 100 according to the first embodiment. Components having substantially the same configurations are thus given identical reference characters, and description of structures, actions, and effects thereof is omitted.

The front-end surface 453A of the cover front portion 470 has a convex shape that rises toward the narrow portion 60. Specifically, the front-end surface 453A has such a shape that the peripheral edge thereof is continuous with the inner peripheral surfaces of the injection holes 55 and that is sloped gently along the penetrating direction of the injection holes 55. The front-end surface 453A has a top portion positioned in the first region 73, and is formed as such a gentle curved surface that the position of the top portion is not over the positions of the upper portions of the injection holes 55. The shape of the front-end surface 453A can be changed, as appropriate, in accordance with the position and the penetrating direction of the injection holes 55 so as to guide the flame that has passed through the narrow portion 60 toward the injection holes 55.

According to the present embodiment, the flame that has passed through the narrow portion 60 can be caused to move along the front-end surface 453A of the cover front portion 470 toward the injection holes 55, and it is thus possible to cause the flame to be injected from the injection holes 55 toward the outside in the radial direction of the spark plug 400.

Fifth Embodiment

Figure 9:
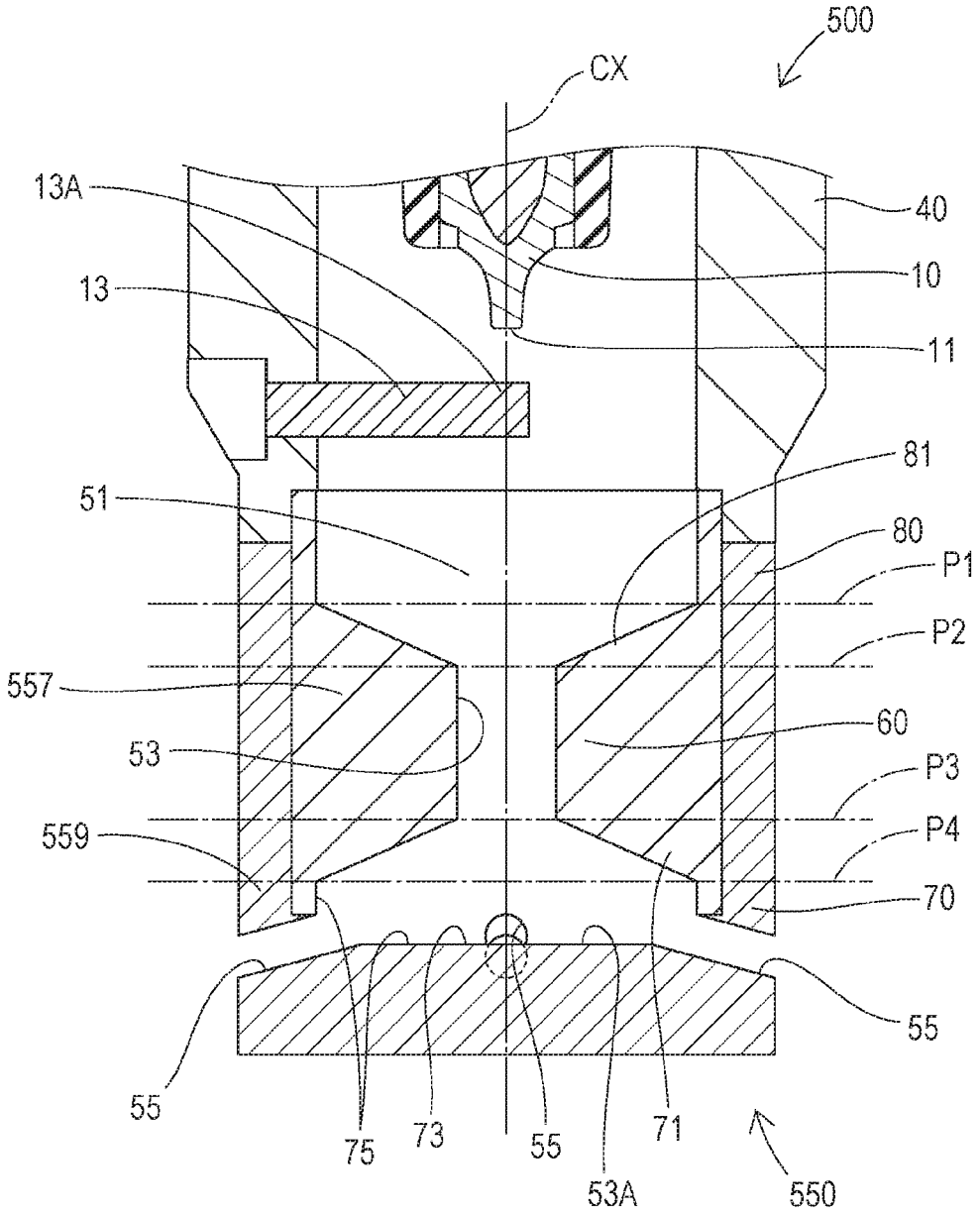
FIG. 9 is a partial enlarged sectional view of a spark plug according to a fifth embodiment.

Next, a spark plug 500 according to a fifth embodiment will be described with reference to FIG. 9. The spark plug 500 of the fifth embodiment differs from the spark plug 100 according to the first embodiment in terms of the configuration of a first member 557 and a second member 559 of a cover portion 550. The other configurations are substantially the same as those in the spark plug 100 according to the first embodiment. Components having substantially the same configurations are thus given identical reference characters, and description of structure, actions, and effects thereof is omitted.

The cover portion 550 includes the first member 557 and the second member 559. The first member 557 is a member that forms at least the narrow portion 60. Specifically, the first member 557 is a member that constitutes, in the cover portion 550, the inner peripheral side of a portion on the rear side with respect to the positions of the injection holes 55. As a result of a circular columnar component slightly smaller than the cover portion 550 being machined from both front and rear sides, the first member 557 is provided with the shape of the cover rear portion 80, the narrow portion 60, and the front tapered portion 71 of the cover front portion 70. The second member 559 is a member that constitutes, in the cover portion 550, the outer peripheral side of a portion on the rear side with respect to the positions of the injection holes 55, and a portion on the front side including the positions of the injection holes 55. As a result of a bottomed cylindrical component being machined from the rear side, the second member 559 is provided with the shape of a front-end-side portion of the cover front portion 70. The first member 557 and the second member 559 are, for example, welded to be integrated with each other after the first member 557 is pressed and inserted into an inner portion of the second member 559, thereby constituting the cover portion 550.

According to the present embodiment, the narrow portion 60 and the cover front portion 70 are easily formed in the first member 557 and the second member 559, respectively, which facilitates manufacture of the cover portion 50. Further, the second member 559 is joined so as to surround the outer periphery of the first member 557, which is preferable in the point of view of improving the joint strength between the two members 557 and 559.

Different Embodiment (Modification)

The present invention is not limited to the aforementioned embodiments and can be embodied in various forms within the range of the gist thereof.

(1) As an alternative to the aforementioned embodiments, the configuration of the narrow portion can be changed, as appropriate. In the first embodiment, a configuration in which a portion of the cover portion from the second plane up to the third plane is the narrow portion is presented as an example; however, the narrow portion may be, for example, a predetermined portion from the second plane up to the third plane. In the aforementioned embodiments, a configuration in which the thickness of the narrow portion is larger than the thickness of the other portions is presented as an example; however, the thickness of the narrow portion may be equal to the thickness of the other portions. As an alternative to the aforementioned embodiments, the cross-sectional area of the narrow portion can be designed, as appropriate.

(2) As an alternative to the aforementioned embodiments, the configurations of the cover rear portion and the cover front portion can be changed, as appropriate. For example, the cover rear portion is not limited to including the rear tapered portion. The entirety of the cover rear portion may have a tapered shape in which the diameter thereof decreases continuously toward the narrow portion. The cover front portion is not limited to including the front tapered portion. The entirety of the cover front portion may have a tapered shape in which the diameter thereof increases continuously from the narrow portion toward the front end side.

(3) As an alternative to the aforementioned embodiments, the number and the positions of the injection holes, the direction in which the injection holes pass through the cover portion, and the like can be changed, as appropriate. For example, the injection holes may be provided at a position to be opened in the front-end surface in the second region. The penetrating direction of the injection holes can be changed, as appropriate, in accordance with the shape and the like of a combustion chamber in which the spark plug is set.

(4) In the third embodiment, there is presented as an example a configuration in which, in the inner wall surface of the cover portion, all of the portions in each of which the inner diameter thereof changes are portions where the inner diameter changes gradually; however, the configuration is not limited thereto. A configuration in which at least one of the portions in each of which the inner diameter thereof changes is a portion where the inner diameter changes gradually may be employed.

(5) In the aforementioned embodiment, there is presented as an example a configuration in which the cover portion includes the first member and the second member; however, the configuration is not limited thereto. For example, the cover portion may be constituted by only a single member.

As an alternative to the first embodiment and the fifth embodiment, the configurations of the first member and the second member can be changed, as appropriate.

What is claimed is:

1. A spark plug comprising:

a center electrode;

a ground electrode that includes a facing portion facing a front end portion of the center electrode and forms a discharge gap between the facing portion and the front end portion of the center electrode;

a cylindrical insulator that accommodates the center electrode therein with the front end portion of the center electrode being exposed from a front end of the insulator;

a metal shell that accommodates the insulator therein; and a cover portion that covers, from a front end side of the spark plug, the front end portion of the center electrode and the facing portion of the ground electrode to form a pre-chamber, the cover portion including an injection hole that is a through hole, wherein, regarding a cross-sectional area of a region surrounded by an inner wall surface of the cover portion in a cross section taken along a plane perpendicular to an axial line of the spark plug, the cover portion includes a narrow portion positioned on the front end side with respect to the ground electrode in a direction of the axial line and narrowed such that the cross-sectional area is smallest, and a cover front portion positioned on a front end side of the narrow portion and having the cross-sectional area that is larger than the cross-sectional area of the narrow portion and that is largest at a front end of the cover front portion, wherein the cover front portion has a first region that is obtained by projecting a region of the narrow portion surrounded by the inner wall surface onto a front-end-side surface of the inner wall surface in the direction of the axial line, and a second region positioned in the inner wall surface to surround the first region, and wherein only the second region includes the injection hole.

2. The spark plug according to claim 1, wherein the cover portion further includes, on the front end side with respect to the ground electrode, a cover rear portion positioned on a rear end side of the narrow portion, and wherein, when the cross-sectional area of the cover rear portion that is largest is denoted by a first cross-sectional area S1 and when the cross-sectional area of the narrow portion is denoted by a second cross-sectional area S2, the second cross-sectional area S2 is 0.05 times or more and 0.15 times or less the first cross-sectional area S1.

3. The spark plug according to claim 1, wherein the cover portion further includes, on the front end side with respect to the ground electrode, a cover rear portion positioned on a rear end side of the narrow portion, and wherein the cover rear portion includes a first tapered portion having a shape in which a diameter thereof decreases continuously toward the narrow portion.

4. The spark plug according to claim 3, wherein the cover rear portion includes, between the first tapered portion and the narrow portion, a second tapered portion having a shape in which a diameter thereof decreases continuously toward the narrow portion, and wherein an angle made by the inner wall surface of the second tapered portion and the axial line is smaller than an angle made by the inner wall surface of the first tapered portion and the axial line.

5. The spark plug according to claim 1, wherein the cover front portion includes, at a position on a rear end side with respect to the injection hole, a third tapered portion having a shape in which a diameter thereof increases continuously from the narrow portion toward the front end side.

6. The spark plug according to claim 1, wherein, in the inner wall surface of the cover portion, at least one of portions in each of which an inner diameter thereof changes is a portion where the inner diameter changes gradually.

7. The spark plug according to claim 1, wherein the front-end-side surface of the inner wall surface of the cover front portion has a convex shape that rises toward the narrow portion.

8. The spark plug according to claim 1, wherein the cover portion includes a first member that forms at least the narrow portion, and a second member that forms at least a portion of the cover front portion.

* * * * *